US006141895A

United States Patent [19]

Rost et al.

[11] Patent Number: 6,141,895

[45] Date of Patent: Nov. 7, 2000

[54] MAGAZINE RELEASE CATCH FOR A PISTOL

[75] Inventors: Sebastian Rost, Dachsen; Marcel Rutz, Seuzach, both of Switzerland

[73] Assignee: SIG Arms International AG, Neuhausen am Rheinfall, Switzerland

[21] Appl. No.: 09/123,986

[22] Filed: Jul. 29, 1998

[30] Foreign Application Priority Data

Jul. 29, 1997 [DE] Germany ..... 197 32 656

[51] Int. Cl.[7] ..... F41A 9/61; F41C 25/06; F41C 27/00

[52] U.S. Cl. ..... 42/6

[58] Field of Search ..... 42/6, 7

[56] References Cited

U.S. PATENT DOCUMENTS

| | | | |
|---|---|---|---|
| 3,715,826 | 2/1973 | Seifried | 42/7 |
| 4,326,353 | 4/1982 | Ludwig et al. | 42/7 |
| 4,599,818 | 7/1986 | Fedora et al. | 42/7 |
| 4,638,581 | 1/1987 | Moore | 42/7 |
| 4,713,902 | 12/1987 | Wigton | 42/7 |
| 4,747,224 | 5/1988 | Smith | 42/7 |
| 4,759,144 | 7/1988 | Egan et al. | 42/7 |
| 5,058,301 | 10/1991 | Lishness et al. | 42/7 |
| 5,379,541 | 1/1995 | Bammate | 42/7 |
| 5,473,834 | 12/1995 | Bammate | 42/7 |

FOREIGN PATENT DOCUMENTS

| | | |
|---|---|---|
| 0 364 408 | 4/1990 | European Pat. Off. . |
| 28 45 121 | 4/1979 | Germany . |

*Primary Examiner*—Michael J. Carone
*Assistant Examiner*—Denise J Buckley
*Attorney, Agent, or Firm*—Venable; Gabor J. Kelemen

[57] ABSTRACT

A pistol includes a pistol grip; an elongated well provided in the pistol grip for receiving a magazine insertable into the well from below; a trigger guard carried by the pistol grip and having a region forming a transition to the pistol grip; and a manually engageable magazine release catch disposed in the transition region and extending into the well. The magazine release catch has a normal position for locking the magazine when disposed in the well and a manually depressed position for releasing the magazine when disposed in the well. The magazine release catch further has a manual engagement face exposed in the transition region and has, in a side view of the pistol, a triangular shape having three rounded corners. One of the corners is oriented in a forward direction of the pistol and the side of the triangular shape facing the forward-oriented corner extends approximately parallel to the length of the well.

13 Claims, 3 Drawing Sheets

3
22
27
21
24
25
20
9
26
12
30
8
2
10
5
6
28
29

II
21
23
20
II

MAGAZINE RELEASE CATCH FOR A PISTOL

CROSS REFERENCE TO RELATED APPLICATION

This application claims the priority of German Application No. 197 32 656.0 filed Jul. 29, 1997, which is incorporated herein by reference.

BACKGROUND OF THE INVENTION

Conventionally, a pistol grip is provided with a well into which a magazine (clip) is inserted from below. In the upper region of the pistol grip a magazine release catch is transversely shiftable and is biased into a locking position by a spring. In the locking position a lug of the magazine release catch extends into a corresponding recess provided in the magazine wall. For removing the magazine the manually engageable portion of the magazine release catch is depressed to move the lug of the magazine release catch out of the magazine recess.

Magazine release catches of the above-outlined type are described, for example in published European Application 364,408 or German Offenlegungsschrift (application published without examination) 28 45 121. The known magazine release catches described therein are disposed in the region of the transition of the trigger guard into the pistol grip. The solutions described in both of the above-identified prior art require relatively large widths measured in the length dimension of the pistol partly because of the required safety measures that protect against rotation and partly because of structural requirements.

SUMMARY OF THE INVENTION

It is an object of the invention to provide an improved magazine release catch which has an optimized configuration for avoiding the above-discussed disadvantage.

This object and others to become apparent as the specification progresses, are accomplished by the invention, according to which, briefly stated, the pistol includes a pistol grip; an elongated well provided in the pistol grip for receiving a magazine insertable into the well from below; a trigger guard carried by the pistol grip and having a region forming a transition to the pistol grip; and a manually engageable magazine release catch disposed in the transition region and extending into the well. The magazine release catch has a normal position for locking the magazine when disposed in the well and a manually depressed position for releasing the magazine when disposed in the well. The magazine release catch further has a manual engagement face exposed in the transition region and has, in a side view of the pistol, a triangular shape having three rounded corners. One of the corners is oriented in a forward direction of the pistol and the side of the triangular shape facing the forward-oriented corner extends approximately parallel to the length of the well.

By virtue of the triangular shape of the magazine release catch, a superior securement against rotation is achieved while maintaining the cross-sectional surface area small. Because one of the faces of the magazine release catch is approximately parallel with the longitudinal direction of the magazine and further, the oppositely located round edge is forwardly directed and the magazine release catch is integrated in the structure forming the transition from the trigger guard to the pistol grip, the magazine release catch may be relocated farther in a forward direction than in conventional arrangements. As a result, the magazine well may also be relocated forwardly relative to the trigger. In this manner the very important grip dimension from the rearward grip end towards the trigger may be reduced.

DESCRIPTION OF THE PREFERRED EMBODIMENT

Figure 1:
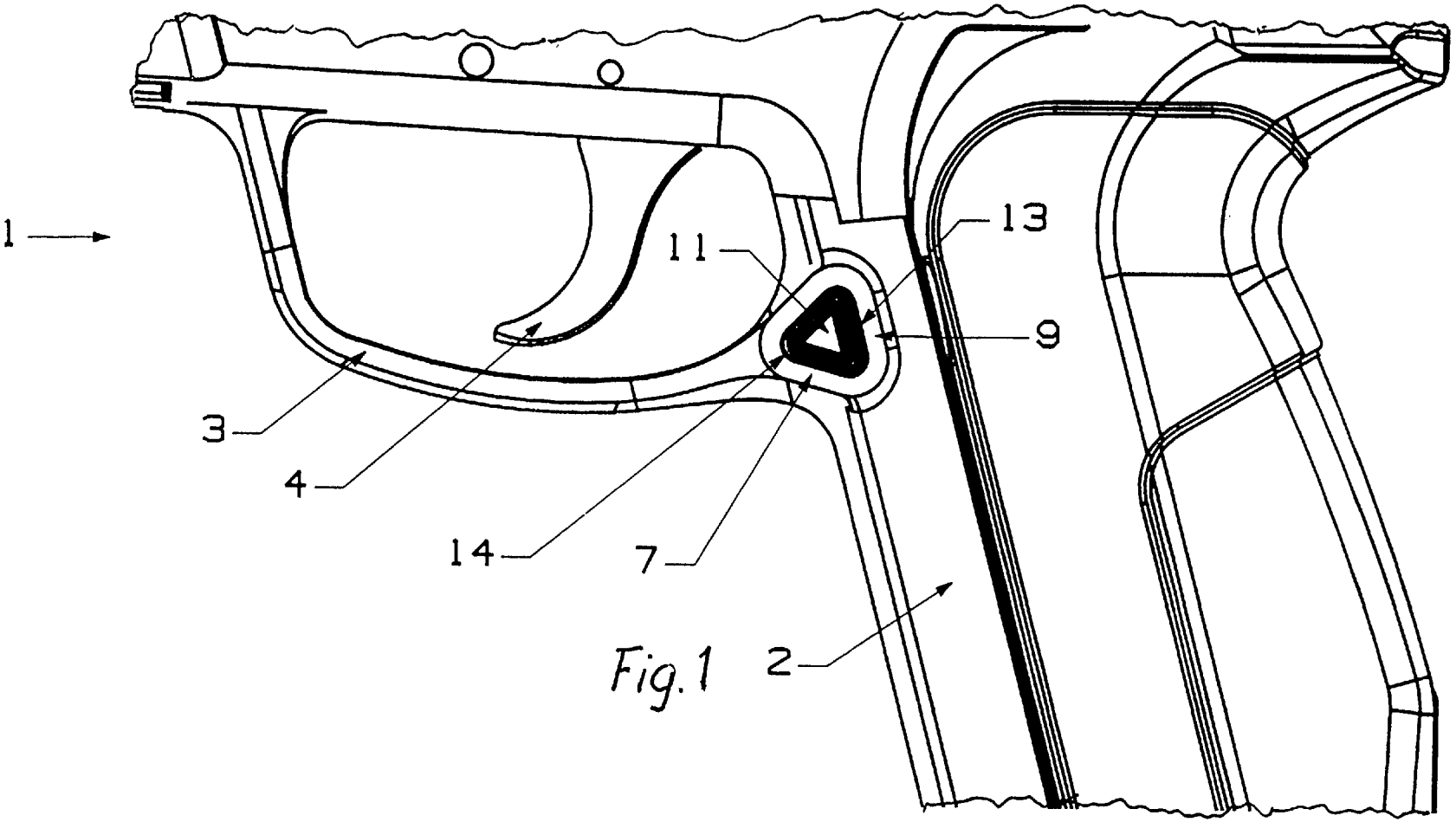
FIG. 1 is a side elevational view of one part of a pistol incorporating the invention.
Figure 2:
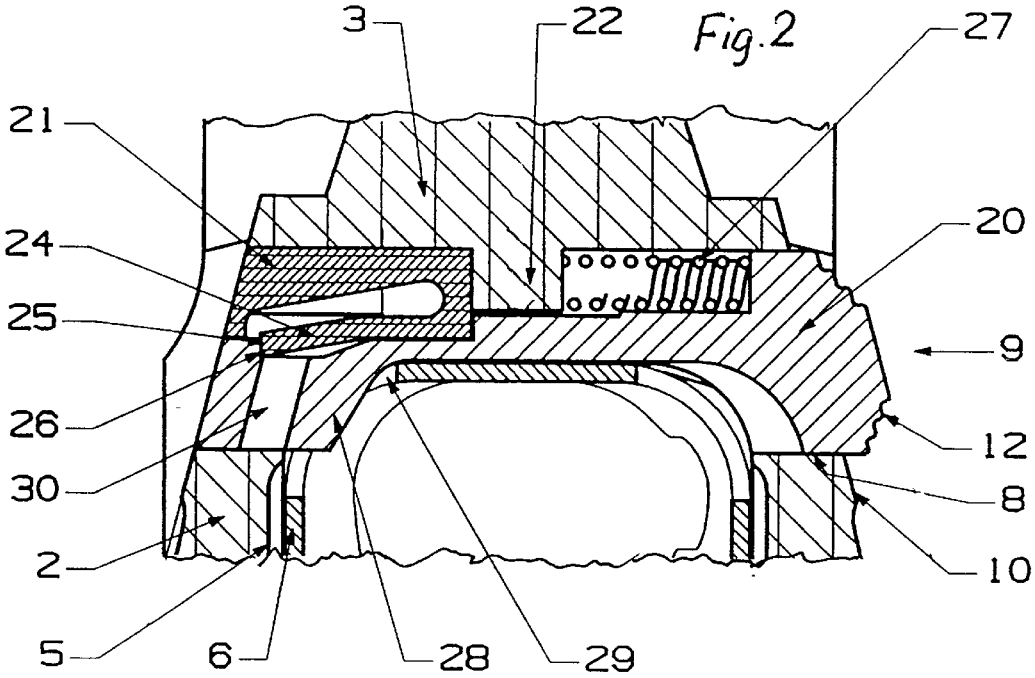
FIG. 2 is a sectional view taken along line II—II of FIG. 3.
Figure 3:
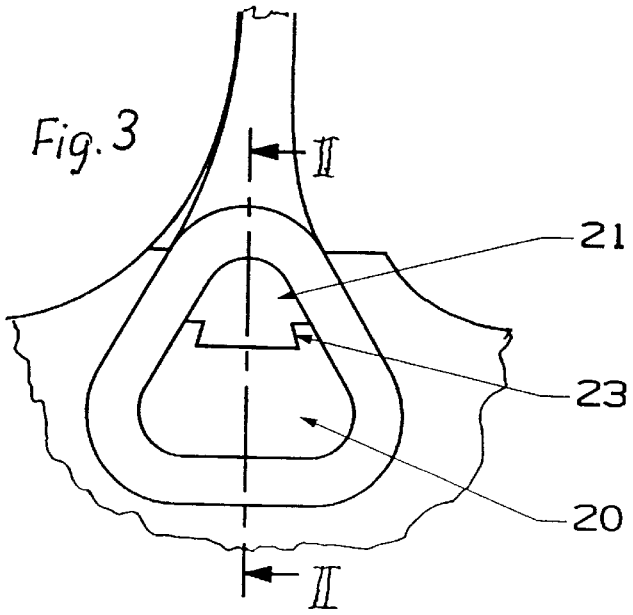
FIG. 3 is a rear view of the magazine release catch according to the invention.

Turning to FIG. 1, the pistol 1 shown fragmentarily therein has a pistol grip 2 on which, as a one-piece member, a trigger guard 3 is formed for protecting a trigger 4. Within the pistol grip 2, in the longitudinal direction thereof, a magazine well 5 extends, into which a magazine 6 may be introduced from below. At the transition to the pistol grip 2 the trigger guard 3 is widened in a delta-shaped region as designated at 7. Also referring to FIG. 2, a transversely extending, approximately triangular, prismatic-cylindrical opening 8 having rounded edges is provided in the enlarged region 7.

In the opening 8 a magazine release catch 9 is longitudinally shiftably disposed. The release catch 9 has a manually engageable surface manual engagement face 11 which is knurled at 12 and which projects beyond the lateral face 10 of the pistol grip 2 and the trigger guard 3. As seen in side view, the manually engageable surface 11, similarly to the opening 8, has the shape of an equilateral triangle provided with rounded edges. One side 13 of the triangle is approximately parallel to the longitudinal direction of the pistol grip 2 and the well 5. The rounded corner 14 facing the side 13 is oriented in a forward direction of the pistol.

By means of the above-outlined configuration an optimal utilization of the space at the transition from the trigger guard 3 to the pistol grip 2 is achieved, and the release catch 9 is secured against rotation by virtue of the fact that its cross-sectionally triangular shape complementally fits into the cross-sectionally triangular opening (channel) 8. The magazine well 5 may be located further in a forward direction than in conventional magazine release catches which may not be integrated into the shape of the trigger guard as advantageously as in the construction according to the invention.

The magazine release catch 9 is formed of a catch body 20 and a catch member 21 which is inserted on the catch body 20 at its side opposite the manually engageable face 11. The catch member 21 which in its basic position lies against an abutment strip 22 of the pistol grip 2, is guided in a groove which may be a dovetail guide 23 of the catch body 20. Further, the catch member 21 is provided with an integral, one-piece resilient tongue 24 having a detent lug 25 which is snapped behind a shoulder 26 of the catch body 20. The catch body 20 is continuously urged into the basic (normal, not depressed) position by means of a biased spring 27 which is countersupported by the abutment strip 22. In the basic position a lug 28 of the catch body 20 extends into a recess 29 provided in one of the magazine walls. When the release catch 9 is depressed, the magazine 6 is released.

Figure 2A:
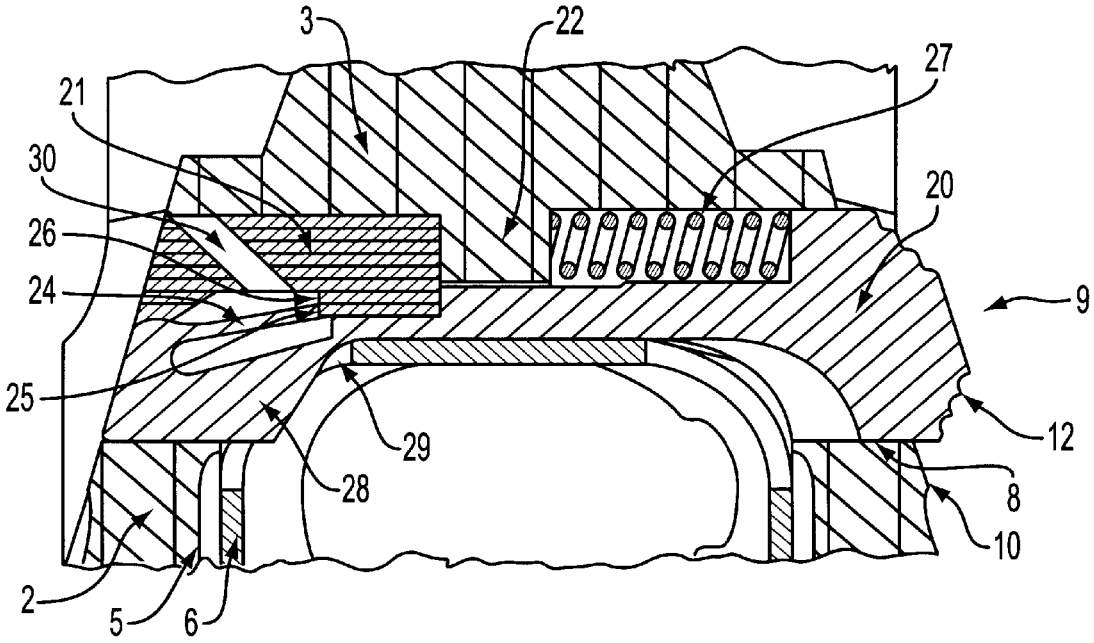
FIG. 2*a* is a view similar to FIG. 2, illustrating a variant.

FIG. 2*a* shows a variant in which a resilient tongue 24 is a one-piece, integral component with the catch body 20, rather than with the catch member 21.

For disassembling the magazine release catch 9, the latter is depressed, and the detent lug 25 is lifted upwardly by means of a tool (such as a pin) introduced into a bore 30 which is accessible in the depressed position. The access bore 30 is provided in the catch body 20 in the FIG. 2 embodiment and in the catch member 21 in the FIG. 2*a* embodiment. As a result, the catch member 21 may be pulled off and the catch body 20 may be pulled out together with the spring 27. Such a construction of the magazine release catch 9 is of great simplicity; it is formed merely of two components. The catch member 21 may be inexpensively manufactured in an injection molding process. The described construction according to the invention may include magazine release catches of non-circular cross section—sliding in a complemental, form-fitting opening—other than the described triangular shape.

It will be understood that the above description of the present invention is susceptible to various modifications, changes and adaptations, and the same are intended to be comprehended within the meaning and range of equivalents of the appended claims.

What is claimed is:

1. A pistol comprising (a) a pistol grip;

(b) an elongated well provided in said pistol grip for receiving a magazine insertable into said well from below; said well having a length;

(c) a trigger guard carried by said pistol grip and having a region forming a transition to said pistol grip; and (d) a manually engageable magazine release catch disposed in said region and extending into said well; said magazine release catch having a first position for locking the magazine when disposed in said well and a second, manually depressed, longitudinally shifted position for releasing the magazine when disposed in said well; said magazine release catch having a manual engagement face exposed in said region; said magazine release catch having, in a side view of the pistol, a triangular shape having three rounded corners; one of said corners being oriented in a forward direction of the pistol and a side of said triangular shape facing said one corner extending approximately parallel to the length of said well.

2. The pistol as defined in claim 1, wherein said magazine release catch comprises (a) a catch body including said manual engagement face;

(b) a spring urging said catch body into said first position; and (c) a catch member snapped onto said catch body at an end portion thereof remote from said manual engagement face.

3. The pistol as defined in claim 2, wherein said catch member includes a resilient detent member formed thereon as a one-piece component thereof; further wherein said detent member has a detent lug and said catch body has a detent opening; said detent lug being received in said detent opening for immobilizing said catch member and said catch body relative to one another; said catch body being provided with a throughgoing opening rendering said detent member accessible for release from said catch body in said second position.

4. The pistol as defined in claim 2, wherein said catch body includes a resilient detent member formed thereon as a one-piece component thereof; further wherein said detent member has a detent lug and said catch member has a detent opening; said detent lug being received in said detent opening for immobilizing said catch member and said catch body relative to one another; said catch member being provided with a throughgoing opening rendering said detent member accessible for release from said catch member in said second position.

5. The pistol as defined in claim 2, wherein said catch body and said catch member are provided with cooperating halves of a dove-tail coupling for sliding said catch member onto said catch body.

6. The pistol as defined in claim 1, wherein said region has a delta shape in a side view of said pistol.

7. The pistol as defined in claim 1, wherein said manual engagement face has a contour shaped as an equilateral triangle having rounded corners.

8. A pistol comprising (a) a pistol grip;

(b) an elongated well provided in said pistol grip for receiving a magazine insertable into said well from below; said well having a length;

(c) a trigger guard carried by said pistol grip and having a region forming a transition to said pistol grip;

(d) an opening of non-circular cross section extending into said pistol grip from said region thereof; and (e) a manually engageable magazine release catch disposed in said opening and extending into said well; said magazine release catch having a non-circular cross section fitting complementally into said opening, whereby a rotation of said magazine release catch relative to said pistol grip is prevented; said magazine release catch having a first position for locking the magazine when disposed in said well and a second, manually depressed position for releasing the magazine when disposed in said well; said magazine release catch having a manual engagement face exposed in said region.

9. The pistol as defined in claim 8, wherein said magazine release catch comprises (a) a catch body including said manual engagement face;

(b) a spring urging said catch body into said first position; and (c) a catch member snapped onto said catch body at an end portion thereof remote from said manual engagement face.

10. The pistol as defined in claim 9, wherein said catch member includes a resilient detent member formed thereon as a one-piece component thereof; further wherein said detent member has a detent lug and said catch body has a detent opening; said detent lug being received in said detent opening for immobilizing said catch member and said catch body relative to one another; said catch body being provided with a throughgoing opening rendering said detent member accessible for release from said catch body in said second position.

11. The pistol as defined in claim 9, wherein said catch body includes a resilient detent member formed thereon as a one-piece component thereof; further wherein said detent member has a detent lug and said catch member has a detent opening; said detent lug being received in said detent opening for immobilizing said catch member and said catch body relative to one another; said catch member being provided with a throughgoing opening rendering said detent member accessible for release from said catch member in said second position.

12. The pistol as defined in claim 9, wherein said catch body and said catch member are provided with cooperating halves of a dove-tail coupling for sliding said catch member on to said catch body.

13. The pistol as defined in claim 8, wherein said region has a delta shape in a side view of said pistol.

* * * * *